United States Patent [19]

Konta

[11] 4,295,651

[45] Oct. 20, 1981

[54] PINBALL ACTUATOR AND FEED MECHANISM

[75] Inventor: Yukio Konta, Gardena, Calif.

[73] Assignee: Tomy Kogyo Co., Inc., Tokyo, Japan

[21] Appl. No.: 114,019

[22] Filed: Jan. 21, 1980

[30] Foreign Application Priority Data

Aug. 28, 1978 [JP] Japan ..... 53-117472

[51] Int. Cl.[3] ..... A63F 7/24

[52] U.S. Cl. ..... 273/121 D; 273/129 S

[58] Field of Search ..... 273/121 R, 121 A, 121 D, 273/122 R, 122 A, 129 S, 129 V; 124/51 R

[56] References Cited

U.S. PATENT DOCUMENTS 1,258,018 3/1918 Kilgore ..... 124/51 R X 1,919,094 7/1933 Cuchran ..... 273/129 S UX

*Primary Examiner*—Anton O. Oechsle

*Attorney, Agent, or Firm*—K. H. Boswell; Edward D. O'Brian

[57] ABSTRACT

In a pinball-type game having a playing surface over which an object is propelled and an object feed and propulsion apparatus for propelling the object across the playing surface includes: a housing associated with said surface and an actuator member mounted on the housing. The actuator is capable of moving from a rest position to an actuated position and back again. When an object is located next to an object contact surface on the end of the actuator and the actuator moves from the actuated position back to the rest position the object is propelled across the playing surface.

Mounted in the housing associated with the actuator is an object feed mechanism which is capable of simultaneously moving the object from a first position adjacent to the feed mechanism to a second position locating the object in an abutting relationship with the contact surface on the actuator as the actuator moves to its actuated position. To accomplish this the actuator is operatively connected to the feed mechanism.

14 Claims, 7 Drawing Figures

10

132
120
60
26
12
16
18
22
20
124
24
30
36
38
108
90
92
94
104
118
34
52
106
86
80
116
76
56
114
110
54
14
40
130
32
42
28

14

118
92
130
32
56
124
90
86
106
68
60
70
72
54
74
78
80
76
40
42
28

PINBALL ACTUATOR AND FEED MECHANISM

BACKGROUND OF THE INVENTION

This invention is directed to an object actuator and feed apparatus which concurrently loads an object in a position to be acted on by the actuator as the actuator is moved from a rest position to an activated position. Upon allowing the actuator to travel again to the rest position the object is propelled by the actuator and the feed mechanism is repositioned to once again refeed the object to the actuator when the actuator is again moved from the rest position to its actuated position.

Pinball games almost universally utilize spherical metal objects as the object which is manipulated across the playing surface. The typical pinball machine will use a plunger of one sort or another to propell the sphere initially across the playing surface. Depending upon the sophistication of the pinball game, the metal sphere is placed in a position to be acted upon by the plunger by a variety of different mechanisms.

In expensive highly sophisticated pinball games the feed mechanism is normally controlled by a solenoid which is activated either by the player using a button or by a trip switch which senses when the previous sphere is no longer in play, but has, in fact, been lodged or deposited in a scoring position or has been deposited in "an out of play" receptacle.

In inexpensive pinball games, including toy pinball games, the sophisticated mechanisms of the expensive pinball games cannot be used for obvious reasons. Normally the inexpensive or toy pinball games rely on a gravity feed mechanism and a plurality of metal spheres. At the start of play the metal spheres are lined up in a chute or other similar structure located next to the plunger. As one ball is propelled by the plunger the next ball descends down the chute in line with the plunger. Normally the ball next to the plunger is used to inhibit a second ball from exiting out of the chute. As is obvious from this description this type of gravity feed must be used with a plurality of spheres.

Since only one sphere is normally in play at a time it is considered disadvantageous to require more than one sphere in the pinball game for a number of reasons. included in these reasons are the economics of providing more than one sphere and the possibility of two spheres becoming jammed together either temporarily or permanently in the chute or other narrow channels within the game.

In a pinball game in which only a single sphere is used, in order to make the game more challenging and establish a base line for judging one players skill against the other, it is important to know how many times the single sphere is actually propelled by the plunger, i.e. the number of shots the player took. Some toy pinball games are equipped with a counting system for noting the number of shots taken, however, these generally are independent and separate from the plunger itself and require the players to specifically manipulate a separate mechanism and thus are susceptible to being forgotten. Whether or not a shot was actually recorded can therefore lead to controversy especially when small children are using the game.

BRIEF SUMMARY OF THE INVENTION

In view of the above it is considered that there exists a need for an actuator and feed apparatus for an inexpensive or toy pinball game which allows the game to only utilize one sphere. Further, it is considered that there exists a need that the feed mechanism automatically count or maintain a register of the number of shots taken. It is therefore an object of this game to fulfill the above needs and additionally supply an actuator and feed mechanism which is simple in operation and construction and therefore both economical to manufacture and reliable in its use.

These and other objects which will become evident from the remainder of this specification are achieved by providing in a game having a playing surface an object feed and propulsion apparatus for propelling an object across the playing surface which comprises: a housing associated with said surface; an actuator means movably mounted on said housing and capable of moving from a rest position to an actuated position, said actuator means including an object contact surface, said actuator means capable of propelling said object across said surface when said actuator means moves from said activated position to said rest position and said object is located in an abutting relationship with said contact surface; an object feed means movably mounted on said housing and capable of contacting an object when said object is in a first position wherein said object is located adjacent to said object feed means and moving said object from said first position to a second position wherein said object is located in said abutting relationship with said contact surface; connecting means operatively associated with said actuator means and said object feed means and capable of translating motion of said actuator means into motion of said object feed means as said actuator means moves from a rest position into said activated position to move said object feed means causing said object to move from said first position to said second position.

Further associated with the object feed means is a movable means mounted on said housing in association with said object feed means and capable of moving independently from the movement of said object feed means and including an engagement means which is capable of moving said movable means when a force is applied to said engagement means; said object capable of simultaneously cooperatively engaging both said engagement means and said feed means transferring force from the movement of said feed means to said engagement means causing said movable means to move simultaneously as said object is transferred from said first position to said second position.

Said movable means capable of moving in step wise increments, each of said increments corresponding to the movement of said object from said first position to said second position. Said movable means also including an indicator means for indicating each of said increments and inhibitory means capable of inhibiting said feed means from moving said object from said first position to said second position.

The invention shown in the figures and described in this specification utilizes certain principles and/or concepts as are set forth and claimed in the appended claims. Those skilled in the arts to which this invention pertains will realize that these principles and concepts can be used with a number of differently appearing embodiments differing from the exact embodiment shown in the figures and described in the specification. For this reason this invention is to be construed in light of the claims appended hereto and is not to be construed as being limited to the embodiment described and shown.

DETAILED DESCRIPTION

Figure 1:
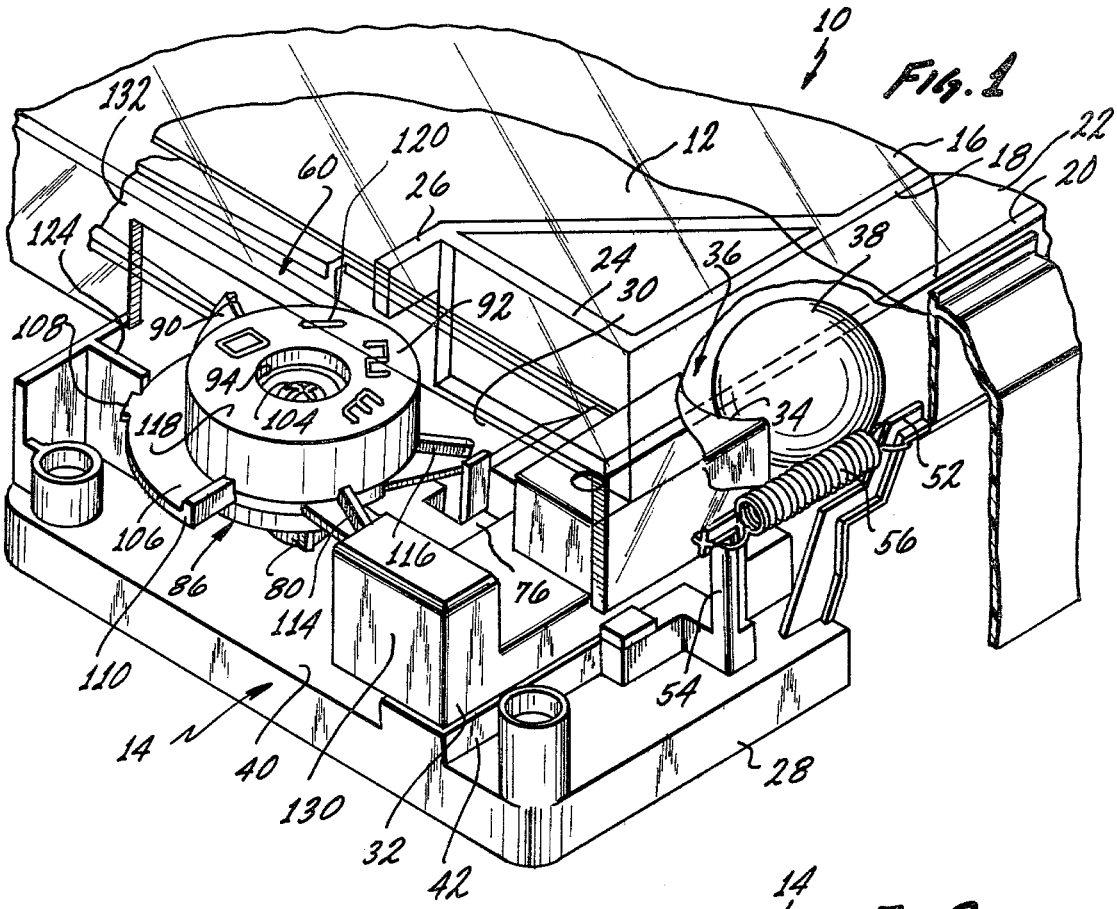
FIG. 1 is an isometric view of the apparatus of the invention and also includes certain portions of the remaining parts of a pinball game in which the invention is used and which parts are directly associated with the invention.
Figure 3:
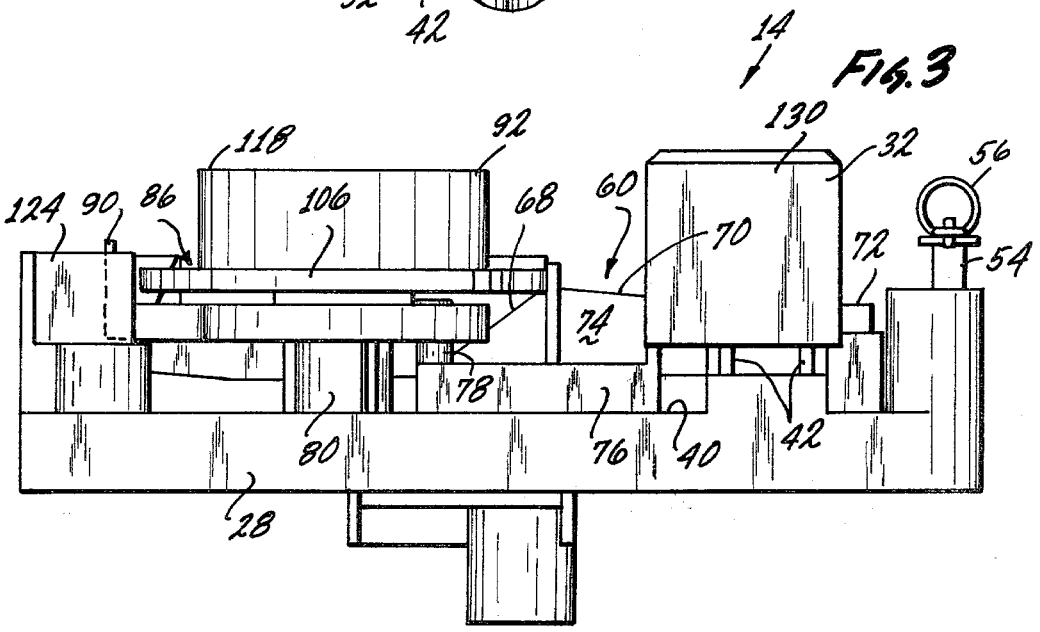
FIG. 3 is a side elevational view of the components shown in FIG. 1.
Figure 7:
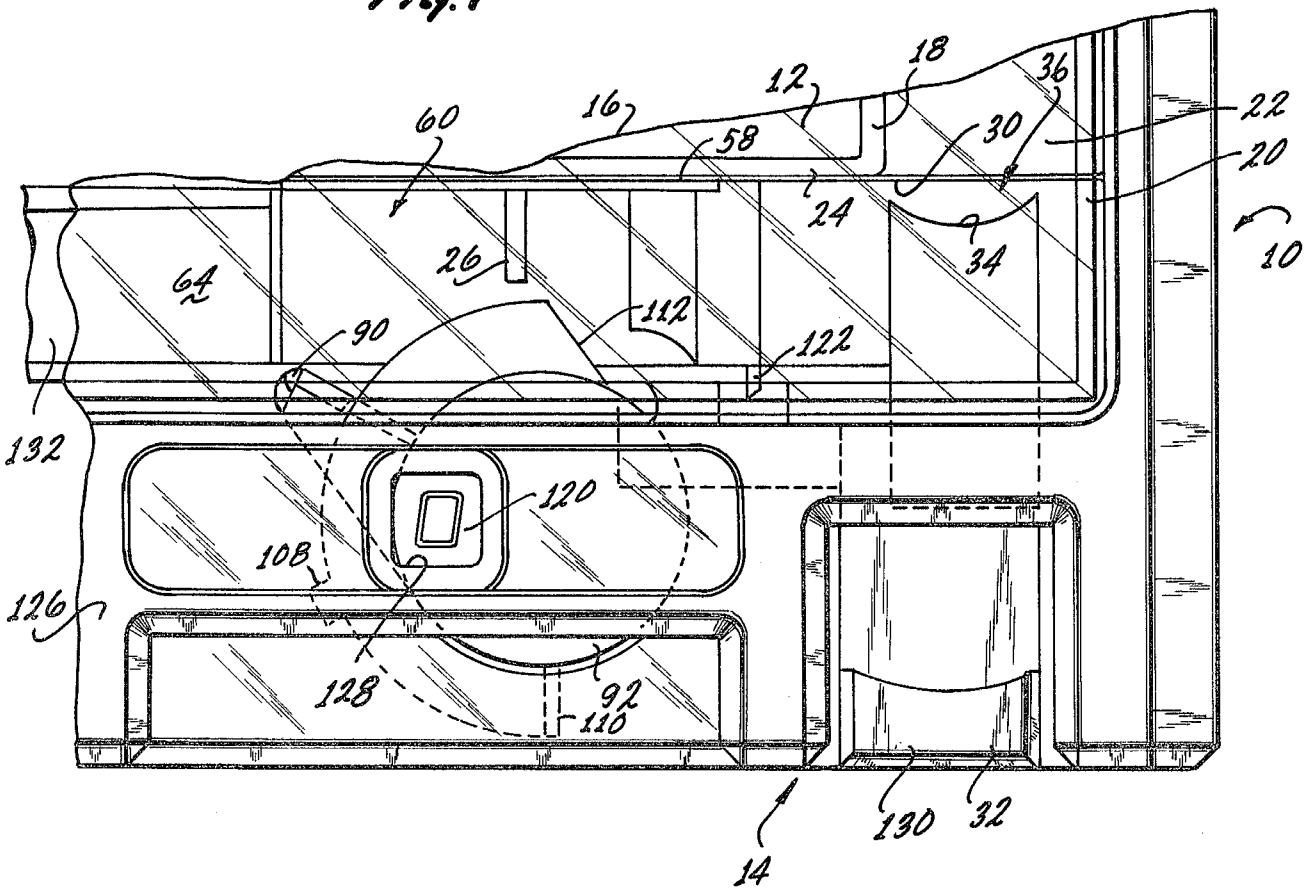
FIG. 7 is a plan view of the components shown in FIG. 1 except they are shown in position within the housing of the pinball game.

A pinball game not shown in the figures, but a portion of which, 10, is shown in FIGS. 1 and 7 includes a playing surface 12 having the ball feed and propulsion or actuator apparatus 14 of the invention located in association with it. A portion of the game's transparent housing 16 covering the playing surface 12 also shown in FIGS. 1 and 7 is located in conjunction with the feed and actuator apparatus 14. Extending downward from the transparent housing 16 is an elongated flange 18 which forms in conjunction with the side 20 of the transparent housing a launching channel 22 extending away from the apparatus 14 up the playing surface 12. Projecting at a 90° angle to flange 18 is a second flange 24 which also is a downward projecting extension of the transparent housing 16. Both flanges 18 and 24 extend all the way from the transparent housing 16 to the playing surface 12 and abut against the playing surface 12. A third flange 26 parallel with flange 18 and at a 90° angle with flange 24 extends part way down from transparent housing 16. The function of flanges 24 and 26 will be evident below.

A housing 28 is located in the portion 10 of the game and abuts against the edge 30 of playing surface 12. Located on the housing 28 is an object actuator 32. The actuator 32 slides on the housing 28 and includes a curved object contact surface 34 located adjacent to channel 22. The actuator 32 has a rest position wherein the object contact surface 34 is located at the mouth 36 of the launching channel 22. The actuator 34 slides on housing 28 away from mouth 36 to a second position or activated position wherein the object contact surface 34 is displaced laterally from the mouth 36. When the object 38, a typical metal sphere or pinball, is located in an abutting relationship with the object contact surface 34 and the actuator 32 is in its actuated position and then allowed to move to its rest position, as hereinafter described, the object 38 is propelled up the channel 22 to be expelled out of the channel 22 onto the upper portion (not shown or numbered) of the playing surface 12 putting the object into play on the playing surface 12 of the pinball game.

The upper surface 40 of the housing 28 contains two upstanding flanges collectively identified by the numeral 42. The area in upper surface 40 between the flanges 42 is cut away forming a slot 44. A downwardly extending finger 46 integrally formed as part of the actuator 32 fits between the flanges 42 and into the slot 44. A wide headed screw 48 is screwed into the bottom of finger 46 from the underside 50 of housing 28 fixedly retaining the actuator 32 on the housing 28. The finger 46 slides between the flanges 42 maintaining movement of the actuator 32 along a line parallel with the flanges 42 which in turn are parallel to the launching channel 22. A small peg 52 extends upwardly near the upper right hand corner of housing 28 and is located in line with a peg 54 extending upwardly from the right hand side of actuator 32. A spring 56 fits over pegs 52 and 54 and biases the actuator 32 toward its rest position.

Figure 2:
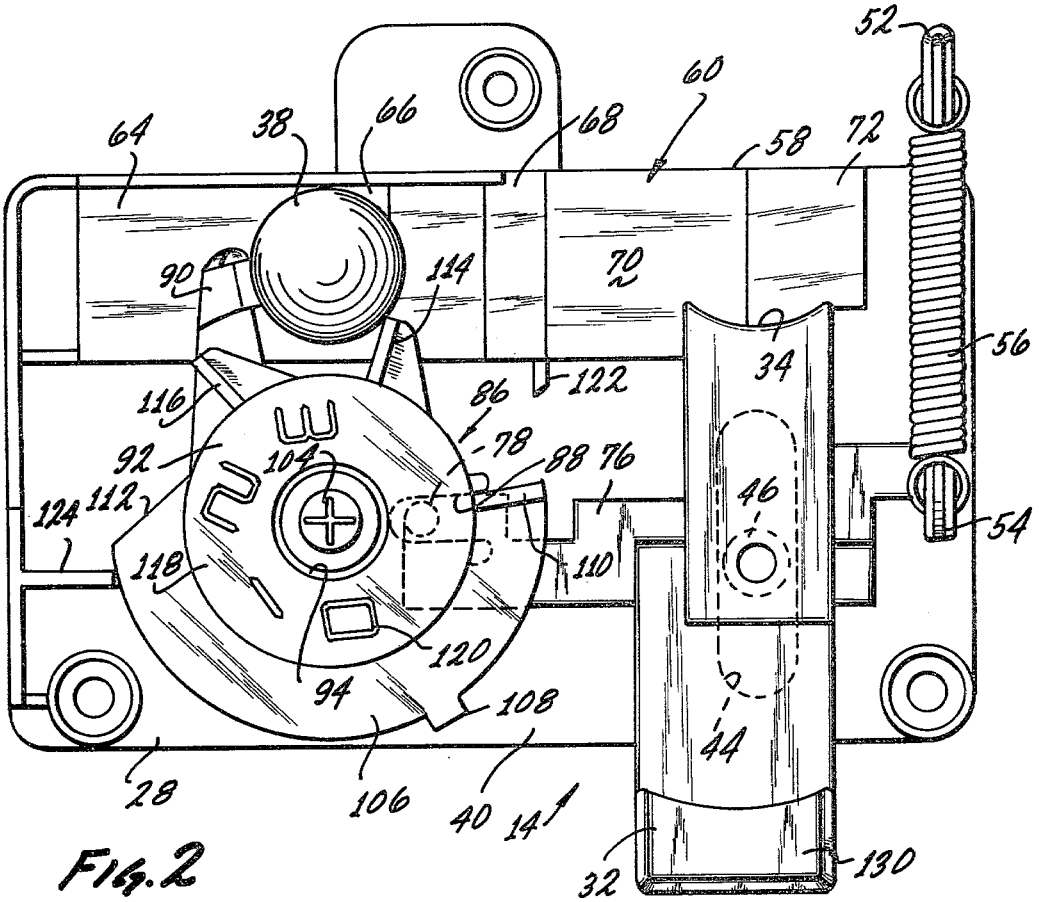
FIG. 2 is a top plan view of the components of this invention.
Figure 4:
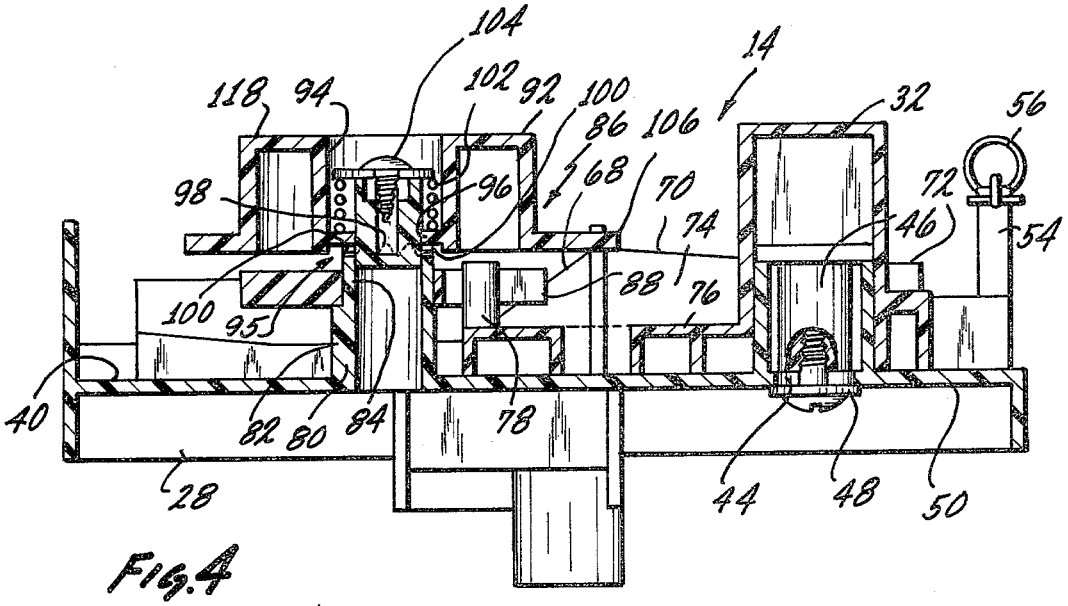
FIG. 4 is a side elevational view in partial section of the components shown in FIG. 3 except that certain of these are in a different spacial relationship compared to FIG. 3.
Figure 5:
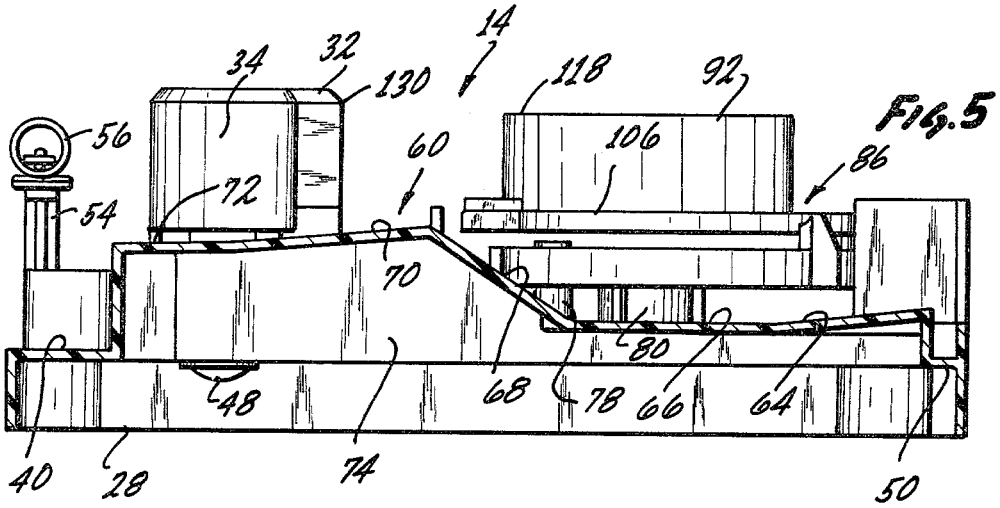
FIG. 5 is a side elevational view in partial section taken about the line 5—5 of FIG. 2.
Figure 6:
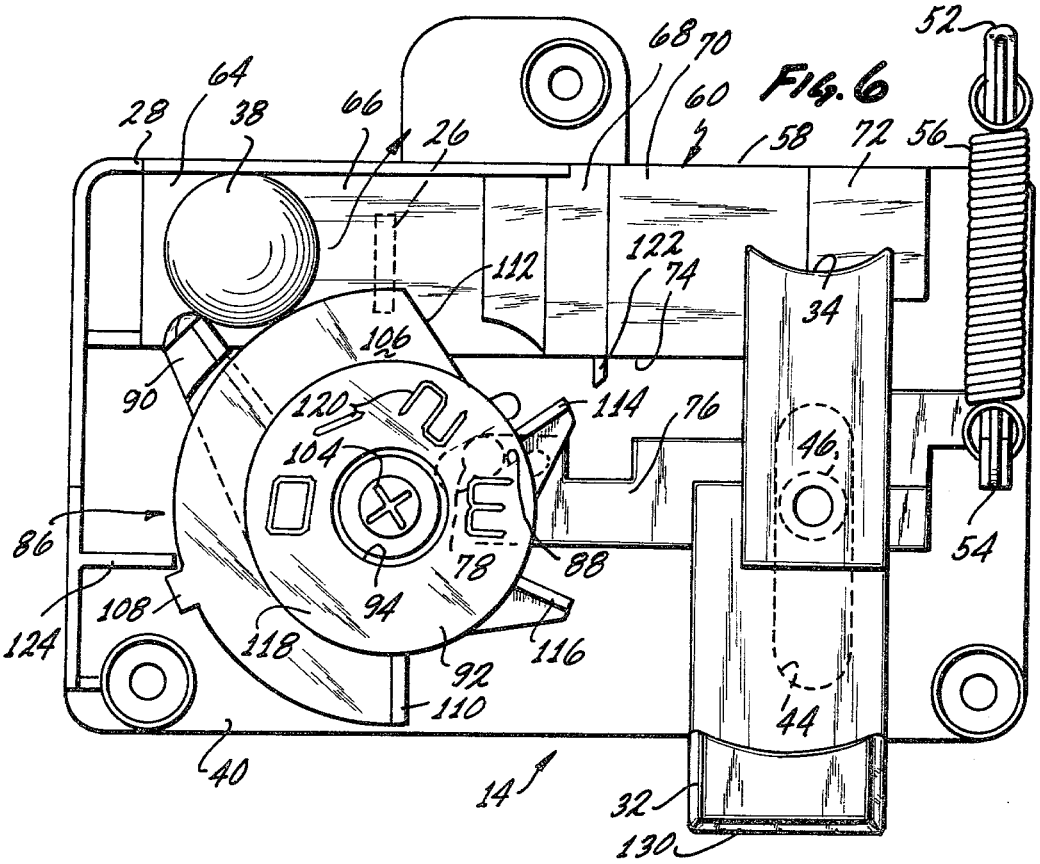
FIG. 6 is a top plan view showing the same components as FIG. 2 except that certain of these components are shown in a different spacial relationship.

The edge 58 of housing 28 which abuts against edge 30 of playing surface 12 has a complex surface 60 extending parallel to it. Extending along a portion of complex surface 60 parallel to edge 58 is an upstanding flange 62. Going from left to right as shown in FIG. 2, complex surface 60 is made up of several surface segments, first a downwardly sloping plane 64, next a level plane 66, then an acutely upwardly sloping plane 68 followed by a second downwardly sloping plane 70 and finally a flat plane 72. Planes 64 and 66 and a portion of plane 68 all abut against flange 62. The line of intersection between planes 70 and 72 is centered beneath the locus of travel of contact surface 34. All of the planes 64 through 72 have a common perpendicular wall 74. The limit of travel of actuator 32 under the bias of spring 56 is determined by interaction of the actuator 32 with the wall 74. Part of the actuator 32 extends outwardly parallel with the longitudinal axis of the complex surface 60 forming arm 76. At the end of arm 76 is a pin 78 which projects upwardly from the surface of the arm 76.

Projecting upwardly from upper surface 40 of housing 28 is an upstanding boss 80 which is divided into a lower segment 82 having a larger diameter than upper segment 84. An object feed member 86 essentially a circular disk, fits around the lower segment 82 of boss 80 and is free to rotate thereon. The object feed member 86 includes a slot 88 radially aligned with its center of rotation. The pin 78 on arm 76 slidably fits within slot 88. Extending out from the main portion of object feed member 86 towards complex surface 60 is object feed arm 90. As the actuator 36 is slid from its rest position to its actuated position pin 78 slides parallel to flanges 42 and since pin 78 is located in slot 88 the linear sliding motion of actuator 32 on housing 28 is transferred into rotary motion of object feed member 86 about boss 80. This causes feed arm 90 to travel in an arcuate path across the portions of complex surface 60 which includes planes 64, 66 and 68.

An object counter-inhibitor member 92 is located above the object feed member 86 about boss 80. The member 92 has a depressed area 94 in its center which in turn has a centralized hole 95 in its bottom wall 96. The upper segment 84 of boss 80 passes through hole 95 locating segment 84 in area 94. Located between the upper and lower segments 82 and 84 of boss 80 respectively is a shoulder 98 shaped in a serpentine-like surface having peaks and depressed areas. On the under side of wall 94 are two projections collectively identified by the numeral 100 which mate with the serpentine-like shoulder 98 by fitting into the depressed areas.

A spring 102 fits within the depressed area 94 about upper segment 84 of boss 80. A wide headed screw 104 is screwed into boss 80 fixedly locating spring 102 in the depression 94. The spring 102 is compressed between the screw 104 and the wall 96 biasing member 92 downwardly such that the projections 100 are biased into the depressed areas of the serpentine-like shoulder 98. Rotation of member 94 as hereinafter explained causes the projections 100 to ride up on the peak of the serpentine-like shoulder 96 against the bias of spring 102 and then descend under the bias of spring 102 into the next adjacent depressed area of the serpentine-like shoulder 98. Movement of the member 92 about boss 80 is therefore in fixed angular increments which are governed by the interaction of the projection 100 with the serpentine-like shoulder 98.

Projecting essentially horizontally outwardly from the member 92 around about 180° of its perimeter is a horizontal flange 106. A tab 108 projects even further outwardly from the surface of the flange 106. Located between the two essentially radial edges 110 and 112 of horizontal flange 106 are a first and second engagement finger 114 and 116, respectively. On the upper surface 118 of counter-inhibitor member 92 are located a plurality of indicating indicia collectively identified by the numeral 120.

Projecting upwardly from the upper surface 40 of housing 28 are two limit flanges 122 and 124. Member 92 is free to rotate about boss 80 within an arc which is governed by interaction of tab 108 with the limit flanges 122 and 124. The rotation of member 92 about boss 80 is independent of the movement of object feed member 86. Counterclockwise rotation of member 92 locks tab 108 against flange 122. At this time edge 110 (hereinafter considered an engagement edge) of horizontal flange 106 is located over the surface of level plane 66. Rotation of member 92 in a clockwise manner causes the projections 100 to ride up over the peaks of the serpentine shoulder 98 and be deposited in the next adjacent depressions of this shoulder 96 which locates engagement finger 114 over level plane 66. A second incremental rotation of member 92 repeats this process and causes engagement finger 116 to be located over level plane 66. A third incremental rotation in a clockwise direction of member 92 brings tab 108 against limit flange 124 and at the same time causes the portion of horizontal flange 106 which has edge 112 thereon to be located over level plane 66. Associated with this movement of member 92 is movement of the indicia 120 in an arc centered at the center of boss 80.

The pinball game contains a cover as is shown in FIG. 7 which fits over the feed and actuator shown in FIG. 1. Included in this cover 126 is a window 128 which is located over the pathway of the indicia 120. One indicia at a time is capable of being exposed through this window. As counter-inhibitor member 92 rotates the interaction of projections 100 with shoulder 98 aside from locating the engagement fingers 114 and 116 and the engagement edge 110 over level plane 66 also centers the individual indicia one at a time in window 128 for viewing. Also exposed through the cover 126 through appropriate holes not numbered are a portion of member 92 and end 130 of actuator 32. The exposed portions of member 92 and the end 130 of actuator 32 are in a position wherein they can be manipulated by the players fingers using the game.

The feed and actuator apparatus works as follows. Incorporated into the playing surface 12 to the left of the feed and actuator apparatus 14 is a depressed groove 132. The object 38 when it is out of play of other components of the pinball, not herein described, rolls by gravity down the playing surface 12 and becomes lodged in groove 132. Groove 132 slants down toward the complex surface 60. The object 38 rolls down the groove 132 and then the downwardly inclined plane 64 locating the object on the level plane 66 between the two sloping planes 64 and 68.

Normally at the beginning of play the counter-inhibiter member 92 is rotated by the player's fingers counterclockwise until tab 108 abuts against the limit flange 122 setting the indicia to starting position. The object 38 rests on the level plane 66 against edge 110 of horizontal flange 106 and directly underneath flange 26. When the end 130 of the actuator 132 is pulled against the bias of spring 56 in a direction away from the mouth 36 of channel 22 movement of the actuator 32 is transferred by the interaction of pin 78 with slot 88 to the object feed member 86 causing feed arm 90 to move clockwise through its arcuate pathway until it contacts the object 38.

After contact of arm 90 with the object 38 is established further movement of the actuator 32 is transferred from the feed arm 90 to the object 38 which in turn is forced against both edge 110 of horizontal flange 106 and the upstanding flange 62. Since the flange 62 is fixed and does not move the object pushes against the engagement edge 110 on member 92 causing the member 92 to rotate through one increment which as noted before is governed by the interaction of the projections 100 with the serpentine shoulder 98. The object which is still engaged with both feed arm 90 and edge 110 passes over plane 66 under flange 26 and then starts ascending the upward plane 68. During the object 38's travel over planes 64 and 66 after it clears flange 106 it comes in contact with flange 24 which helps to maintain the object 38 in proper position on planes 64, 66 and 68. The object 38 after being pushed up the upwardly directed plane 68 goes over the peak between plane 68 and plane 70 and rolls down plane 70 to flat plane 72 locating the object 38 in an abutting relationship with object contact surface 34 of actuator 32. When end 130 of the actuator is released the object 38 is propelled into the mouth 36 and up the channel 22. Concurrently as the actuator 32 slides toward the channel 22 the feed arm 90 rotates counterclockwise until it is once again cleared of the complex surface 60.

When the object 38 clears the launch channel 22 and has traveled over playing surface 12 of the pinball game it once again comes to rest in groove 132. When it rolls down this groove and down the downwardly inclined plane 64 to once again be located on plane 66 it is now positioned against upstanding flange 62 and engagement finger 114.

The next time the activator 32 is pulled against the bias of the spring 56 the feed arm 90 pushes the object 38 against engagement finger 114 causing the engagement finger 114 to rotate clockwise and consequently member 92 to also rotate clockwise. The feed arm 90 continues the movement of the object 38 until it is once again located on flat plane 72 ready to be launched by the actuator 32 up the channel 22. A repeat of movement of the object 38 across the playing surface 12 and down through groove 132 now locates the object on level plane 66 against engagement finger 116. A third movement of the actuator 32 again rotates the feed arm 90 clockwise forcing the object 38 against engagement finger 116 ultimately once again rotating member 92 through a third clockwise increment and again locating the object in a position against contact surface 34 so that it can be once again launched.

After this third launch of the object 38 edge 112 of flange 106 has been rotated until it is directly over the level plane 66. The next time the object comes down groove 132 it is finally located on the surface of downwardly projecting plane 64 wedged between upstanding flange 66 and horizontal flange 106. At this point tab 108 is engaged against limit flange 124. If the actuator 32 is once again moved against the bias of spring 66 the feed arm 90 once again engages the object 38, however, the object 38 cannot be pushed along the complex surface 60 since horizontal flange 106 is in the way and cannot move because of the locking action of tab 108 against limit flange 124. Continued pressure of the feed arm 90 against the object 38 causes the object 38 to be lifted along the edge of upstanding flange 62 and horizontal flange 106 and against the side of flange 26. The object 38 is finally lifted up and over the upstanding flange 62 and becomes located on the playing surface 12 and not in a position to once again be launched.

From the above discussion it can be seen that the object can be launched three times before further launches are inhibited by the horizontal flange 106. Each time the counter-inhibiter member 92 rotates, a different one of the indicia 120 located on it is exposed for viewing through window 108. Rotation of the counter-inhibiter member 92 thus serves to count how many times the object 38 has been launched. After the three launches described above have taken place and further launching of object 38 is prevented by horizontal flange 106 the member 92 is rotated by the player's fingers clockwise until tab 108 abuts against flange 122 and the game is once again ready to be played.

The apparatus of this invention can be used with any number of different pinball type games the only requirement being they must have a playing surface and a metal sphere or object which travels over that playing surface. While the apparatus described has been illustrated as being capable of launching the object three times, a lesser or greater number of launches could also be chosen by simply utilizing a lesser or greater number of engagement fingers and a corresponding different amount of rotations of member 92.

I claim:

1. In a game having a playing surface an object feed and propulsion apparatus for propelling an object across said playing surface which comprises:

a housing associated with said playing surface;

an actuator means movably mounted on said housing and capable of moving from a rest position to an activated position, said actuator means including an actuator-object contact surface, said actuator means capable of propelling said object across said playing surface when said actuator means moves from said activated position to said rest position and said object is located in an abutting relationship with said actuator-object contact surface;

an object feed means movably mounted on said housing and capable of contacting an object when said object is in a first position wherein said object is located adjacent to said object feed means and moving said object from said first position to a second position wherein said object is located in said abutting relationship with said actuator-object surface;

connecting means operatively associated with said actuator means and said object feed means and capable of translating motion of said actuator means into motion of said object feed means as said actuator means moves from said rest position to said activated position to cause said object feed means to move moving said object from said first position to said second position;

movable means mounted on said housing in association with said object feed means and capable of moving independent of movement of said object feed means;

engagement means located on said movable means and capable of moving said movable means in respect to a force applied to said engagement means;

said object capable of simultaneously cooperatively engaging both said engagement means and said object feed means transferring force from the movement of said object feed means to said engagement means and to said movable means to move said movable means simultaneously as said object is transferred from said first position to said second position.

2. The apparatus of claim 1 wherein:

said movable means is capable of moving in step wise increments, each increment corresponding to the movement of said object from said first position to said second position.

3. The apparatus of claim 2 including:

indicator means operatively associated with said movable means and capable of indicating each of said incremental movements of said movable means.

4. The apparatus of claim 2 including:

inhibitory means located in operative association with said movable means and capable of inhibiting said object feed means from moving said object from said first position to said second position after said movable means has moved through a predetermined number of said increments.

5. The apparatus of claim 3 including:

inhibitory means located in operative association with said movable means and capable of (a) inhibiting said object contacting means from moving said object from said first position to said second position (b) and inhibiting engagement of said object with said engagement means, after said movable means has moved through a predetermined number of said increments.

6. The apparatus of claim 5 wherein:

said object feed means comprises an object feed member rotatably mounted on said housing and including an object contact area arcuately movable as said object feed member rotates on said housing;

said actuator means comprises a sliding member slidably mounted on said housing and including a biasing means biasing said sliding member toward said rest position;

said connecting means includes said object feed member having a slot radially aligned with the center of rotation of said object feed member on said housing;

said sliding member including a pin means, said pin means slidably fitting into said slot.

7. The apparatus of claim 6 wherein:

said movable means comprises a rotating member rotatably mounted on said housing coaxial with said object feed member;

said engagement means comprises at least one engagement finger projecting radially from said rotating member toward said arcuate pathway of said object contact area;

said object contact area capable of abutting against said object when said object is in said first position locating said object between said object contact area and said engagement finger to transfer said arcuate movement of said object contact area via said object to said engaging finger rotating said rotating member through one of said increments.

8. The apparatus of claim 7 including:

a plurality of engagement fingers each capable of interacting with the object and each capable of transferring said arcuate movement of said object contact area to rotate said rotating member through one of said increments as said object moves from said first position to said second position.

9. The apparatus of claim 8 wherein:

said housing includes an object guide surface, said rotating member and said object feed member coaxially located one above the other adjacent to said object guide surface;

said object guide surface including a depression in said surface adjacent to where said rotating member and said object feed member are located, said object resting in said depression in said surface when said object is in said first position;

a portion of said arcuate pathway of said object contact area lying above said depression in said surface.

10. The apparatus of claim 9 wherein:

said object guide surface comprises an elongated surface having a downwardly sloping plane at both ends of said elongated surface and said depression comprises a flat plane located intermediate said downwardly sloping planes, an upstanding flange located along one edge of said elongated flat surface and said rotating member and said object feed member located adjacent to the other edge of said elongated surface.

11. The apparatus of claim 10 wherein:

said inhibitory means comprises an outwardly extending flange projecting from a portion of said rotating member and sized to extend over at least a portion of said elongated surface when said rotating member is rotated such that said flange is adjacent to said surface;

said object contact area engaging said object and forcing said object against both said outwardly projecting flange and said upwardly projecting flange lifting said object from said elongated surface and moving said object from said first position to an inoperative position on the other side of said upstanding flange.

12. The apparatus of claim 8 wherein: said indicator means comprises a plurality of indicia located on the surface of said rotating member, each indicia corresponding to one of said increments.

13. In a game having a playing surface an object feed and propulsion apparatus for propelling an object across said playing surface which comprises:

a housing associated with said playing surface;

an actuator means movably mounted on said housing and capable of moving from a rest position to an activated position, said actuator means including an actuator-object contact surface, said actuator means capable of propelling said object across said playing surface when said actuator means moves from said activated position to said rest position and said object is located in an abutting relationship with said actuator-object contact surface;

an object feed means movably mounted on said housing and capable of contacting an object when said object is in a first position wherein said object is located adjacent to said object feed means and moving said object from said first position to a second position wherein said object is located in said abutting relationship with said actuator-object surface;

connecting means operatively associated with said actuator means and said object feed means and capable of translating motion of said actuator means into motion of said object feed means as said actuator means moves from said rest position to said activated position to cause said object feed means to move moving said object from said first position to said second position;

movable means mounted on said housing in association with said object feed means and capable of moving independent of movement of said object feed means;

engagement means located on said movable means and capable of moving said movable means in respect to a force applied to said engagement means;

said object capable of simultaneously cooperatively engaging both said engagement means and said object feed means transferring force from the movement of said object feed means to said engagement means and to said movable means to move said movable means simultaneously as said object is transferred from said first position to said second position;

said object feed means comprises an object feed member rotatably mounted on said housing and including an object contact area arcuately movable as said object feed member rotates on said housing;

said actuator means comprises a sliding member slidably mounted on said housing and including a biasing means biasing said sliding member toward said rest position.

14. The apparatus of claim 13 wherein:

said connecting means includes said object feed member having a slot radially aligned with the center of rotation of said object feed member on said housing;

said sliding member including a pin means, said pin means slidably fitting into said slot.

* * * * *